US007188798B2

(12) United States Patent
Hawighorst et al.

(10) Patent No.: US 7,188,798 B2
(45) Date of Patent: Mar. 13, 2007

(54) DEVICE FOR CONTINUOUS WINDING OF WEBS

(75) Inventors: Thomas Hawighorst, Osnabrueck (DE); Rolf Kammann, Westerkappeln-Velpe (DE); Werner Decker, Ladbergen (DE)

(73) Assignee: Windmoeller and Hoelscher, Lengerich (DE)

( * ) Notice: Subject to any disclaimer, the term of this patent is extended or adjusted under 35 U.S.C. 154(b) by 230 days.

(21) Appl. No.: 10/489,977

(22) PCT Filed: Jul. 1, 2002

(86) PCT No.: PCT/EP02/07272

§ 371 (c)(1),
(2), (4) Date: Mar. 19, 2004

(87) PCT Pub. No.: WO03/035521

PCT Pub. Date: May 1, 2003

(65) Prior Publication Data

US 2004/0245366 A1 Dec. 9, 2004

(30) Foreign Application Priority Data

Oct. 24, 2001 (DE) ..... 101 52 494

(51) Int. Cl.
*B65H 18/26* (2006.01)

(52) U.S. Cl. ..... 242/547; 242/542.3

(58) Field of Classification Search ..... 242/547, 242/527, 527.2, 542.3
See application file for complete search history.

(56) References Cited

U.S. PATENT DOCUMENTS

| | | | | |
|---|---|---|---|---|
| 4,404,831 | A * | 9/1983 | Hild et al. | 72/148 |
| 4,964,587 | A * | 10/1990 | Oki et al. | 242/532 |
| 5,035,373 | A * | 7/1991 | Perrigo | 242/413.3 |
| 5,054,707 | A * | 10/1991 | Olson | 242/533.5 |
| 5,086,986 | A * | 2/1992 | Twente | 242/527.2 |
| 5,273,222 | A | 12/1993 | Hutzenlaub et al. | |
| 5,275,345 | A * | 1/1994 | Stahl et al. | 242/547 |
| 6,109,559 | A * | 8/2000 | Dorfel et al. | 242/533.2 |
| 6,186,438 | B1 * | 2/2001 | Zeppenfeld et al. | 242/547 |
| 2004/0155138 | A1 * | 8/2004 | Kolbe et al. | 242/527.2 |

FOREIGN PATENT DOCUMENTS

| | | |
|---|---|---|
| DE | 24 27 250 A1 | 6/1974 |
| DE | 41 15863 A1 | 5/1991 |
| DE | 198 25 723 A1 | 6/1998 |

* cited by examiner

*Primary Examiner*—William A. Rivera
*Assistant Examiner*—Sang Kim
(74) *Attorney, Agent, or Firm*—Jacobson Holman PLLC

(57) ABSTRACT

Device for continuous winding of webs onto winding shafts or winding cores to winding rollers, with a pressure roller supported in a frame that can be engaged on the winding shaft or winding core. This engagement is effected with limited friction and in a sensitive manner by means of a drive, with the pressure roller being supported on at least one steering rod that is pivot-connected to two guides, the other ends of which are pivot-supported in the frame.

15 Claims, 3 Drawing Sheets

DEVICE FOR CONTINUOUS WINDING OF WEBS

This is a nationalization of PCT/EP02/07272 filed Jul. 1, 2002 and published in German.

BACKGROUND OF THE INVENTION

1. Field of the Invention

The invention relates to a device for continuous winding of webs, preferably webs made of thermoplastic synthetic material, onto winding shafts or winding cores to winding rollers, with arms supporting the winding shaft that is preferably equipped with a drive, with a pressure roller that can be engaged on the winding shaft or winding core, or the forming winding roller, which is supported in a frame, and with a knife separating the web during a roller change.

2. Description of the Related Art

In winding devices of this type, the pressure roller is pressed against the winding core, or the forming winding roller, by means of a drive device in order to achieve a tightly wound winding roller without any trapped air between the individually wound layers. Devices of the previously stated type are known in which the pressure roller is supported on a carriage that is equipped with a drive that moves the pressure roller and presses against the winding core, or the forming winding roller. The carriage movable in the guides of a frame can be moved only against substantial inevitable friction forces; even together with the pressure roller supported on the same, it creates substantial masses that must be moved during the travel of the carriage.

SUMMARY OF THE INVENTION

It is therefore the task of the invention to create a device of the previously stated type that enables an engagement of the pressure roller with the winding core, or the forming winding roller, which is low in friction.

According to the invention, this task is solved in that the pressure roller is supported on at least one steering rod, which is pivot-connected to two guides, the other ends of which are pivot-supported in the frame, and that the steering rod, or one of the guides, is equipped with a drive device.

Purposefully, the pressure roller is supported between two steering rods, each of which is pivot-connected to two guides, the other ends of which are pivot-supported in the frame.

The steering rod with two guides provided according to the invention forms a four-joint carrying system that absorbs the weight of the pressure roller in a favorable manner. The device according to the invention is therefore characterized in that the pressure roller is supported low in friction between steering rods of four-joint systems. In the device according to the invention, the pressure roller can be engaged sensitively with the winding core or the forming winding roller by means of its drive device, because there are no large friction forces that must be overcome. Due to the fact that the pressure roller is not supported on a carriage, the masses to be moved are reduced. The pressure roller is moved by means of its drive in horizontal direction only so that the influence of the mass on the contact force is negligible.

Purposefully, the drive device consists of at least one pneumatic cylinder.

Purposefully, the pressure roller is supported in sections of the steering rod that reach over a guide in the direction of the winding roller. An especially preferred embodiment provides that the guides consist of a front guide or rocker seen from the direction of the winding core or winding roller, which is longer in length than the rear guide. If the winding roller is supported between the sections of the steering rods reaching over the two front guides at a distance to the front guides, the rear, shorter guides pivot the steering rods around the joints at the front guides due to their smaller pivoting radius in such a manner that a pivoting movement of the steering rod superposes the increasing effect of the four-joint system so that the pressure roller performs a linear movement during its displacement in the direction of the winding core or winding roller.

This approximate straight guide can be improved by the fact that the shorter rear guides, based on their pivot bearings, extend from the frame at an acute angle to the longer front guides.

A further embodiment of the invention provides that the guides are supported on a carriage that can be moved in a frame. The carriages are equipped with a controlled drive, which moves the same once the path of the approximate straight guide of the system consisting of the guides and steering rods has been depleted.

BRIEF DESCRIPTION OF THE DRAWINGS

One embodiment of the invention is explained in further detail based on the drawing. It shows.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
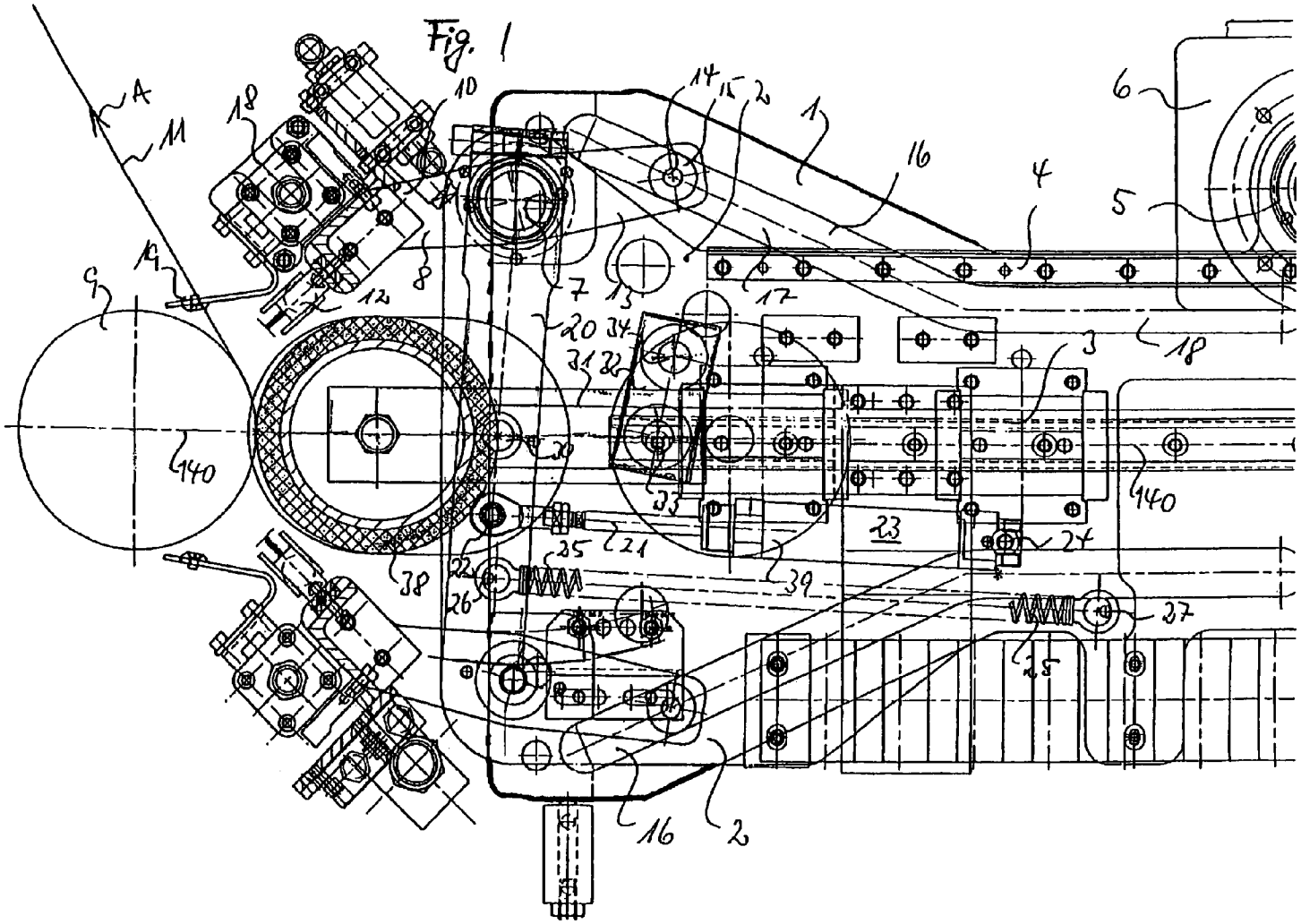
FIG. 1 a side view of the winding device according to the invention with a distant front side wall of the frame, FIG. 2 the four-joint system each consisting of two guides and steering rods for the approximate straight guide of the pressure roller as drawn from FIG. 1, and FIG. 3 an exploded top view of the four-joint system consisting of two guides and one steering rod on one side.

FIG. 1 shows a rear, plate-shaped side component 1, which is part of a frame. The front side component is removed in order to better view the devices arranged between the side components.

A carriage is guided horizontally movable between the side components 1. Only the side wall 2 of the carriage is illustrated, as the front side wall is again removed for reasons of better illustration. The side walls 2 of the carriage are connected to each other by not illustrated traverse members. The side walls 2 are guided in a movable manner in guides 3 of the side components 1 that are illustrated in broken lines. At its upper side edge, at least the side wall 2 is equipped with a gear rod 4, which engages with the pinion gear 5 of a gear motor 6, which is controlled by the electronic machine control for moving the carriage with the side walls 2.

On both sides of a shaft 7 that is supported between the side walls 2, two-armed levers 8 are pivot-supported, the arms 10 of which point in the direction of the winding core 9, which carry the charging electrode 12 that expands across the width of the web 11. The interior arms 13 of the two-armed lever 8 are equipped with axle journals 14, on which rollers 15 are supported, which are guided in guides 16 of the side components 1 of the frame, and which consist of slotted holes. The guides 16 consist of a laterally extending section 17 and, connected to the same, of a section 18 extending parallel to the guide 3.

Attached to the arms 10 of the two-armed lever 8 extending toward the exterior, are not only the electrode 12, but also a linear unit, such as a piston rod-less pneumatic cylinder, which moves a knife 19 across the width of the web 11 for the purpose of cutting the web 11.

On both sides of the shaft 7, front guides or rockers 20 are pivot-supported on the interior sides of the carriage side walls 2, which are pivoted by means of the pneumatic cylinder 23, the piston rods 21 of which are pivot-supported on journals 22 of the rockers 20. The cylinders 23 are pivot-supported on journals 24 of the carriage side walls 2.

Tension springs 25 are arranged below the pneumatic cylinders 23 parallel to the same, the ends of which are suspended from journals 26 of the rocker 20, and journals 27 of the side wall 2.

The rockers 20 carry axle journals 30 above the pneumatic cylinders 23, on which coupling elements 31 are supported. At their rear ends, the coupling elements 31 are pivot-connected to rear guides 32 in the joints 33, the upper ends of which are pivot-supported on axle journals 34 of the side walls 2. The coupling elements 31, which may be embodied as steering rods, transfer the rockers 20 in the direction of the winding core 9. The pressure roller 38 is supported between the free ends of the coupling elements 31.

The electrode 12 may consist of a number of needles, and is laterally encased by rails that provide protective cover.

The arrangement of the knife 19 with the piston rod-free pneumatic cylinder on the carrier of the electrodes 12 results in a cut closely above the roller gap between the winding core 9 and the pressure roller 38 once the knife is activated so that a web start with a short flap is created.

The web 11 moves in the direction of arrow A, and is fed to the pressure roller 38 by a guide roller 39, which may be supported, for example, between the side walls 2 of the carriage.

The two-armed levers 8 with electrodes 12 and knives 19, as well as the guides 16 for the rollers 15 of the interior arms of the two-armed levers 8 are arranged laterally reversed to a midplane 140 which extends through the axes of the winding core 9 and the pressure roller 38. In this way, a simple conversion of the winding device to winding from left to right is possible.

Figure 2:
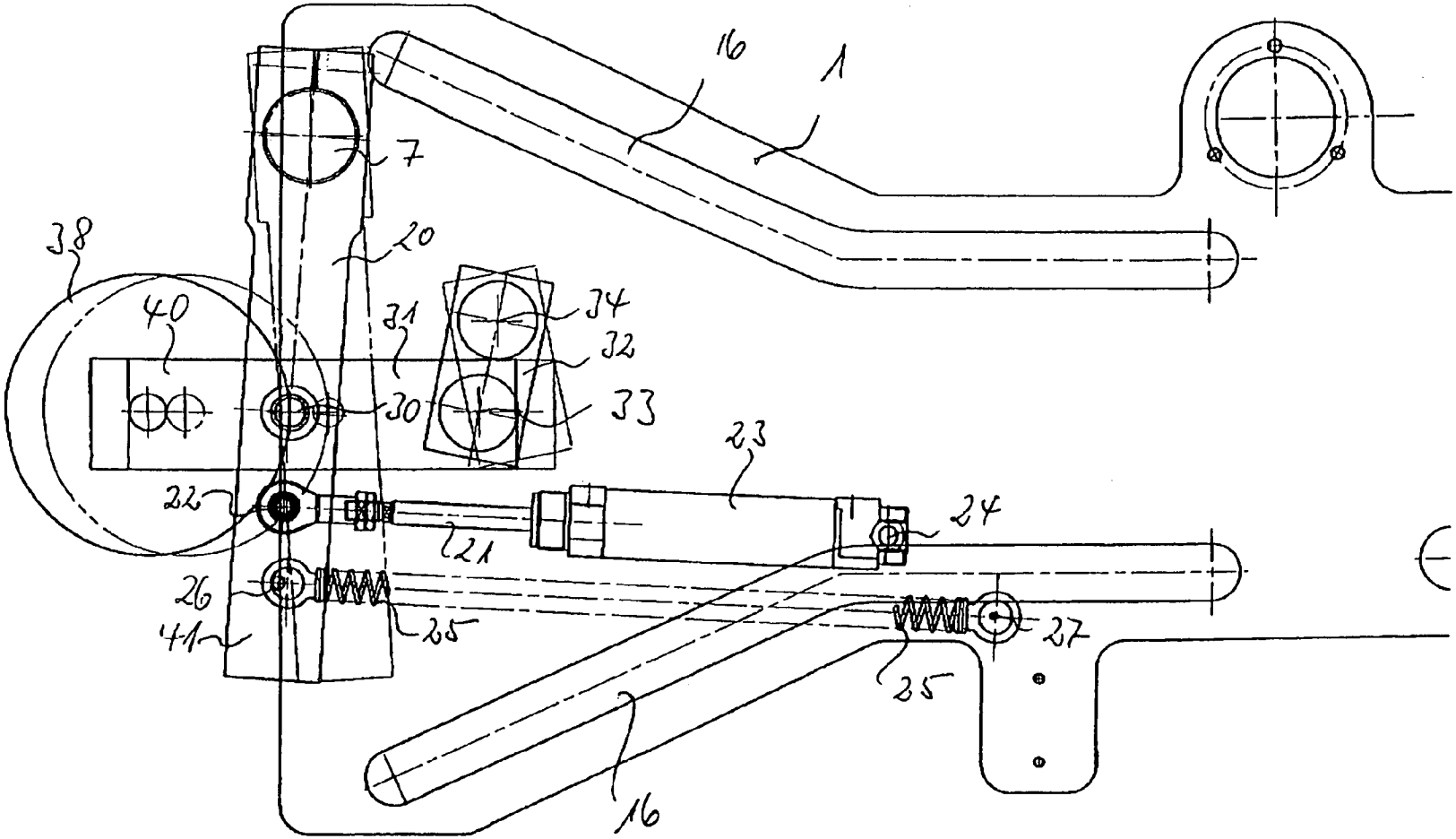
Figure 3:
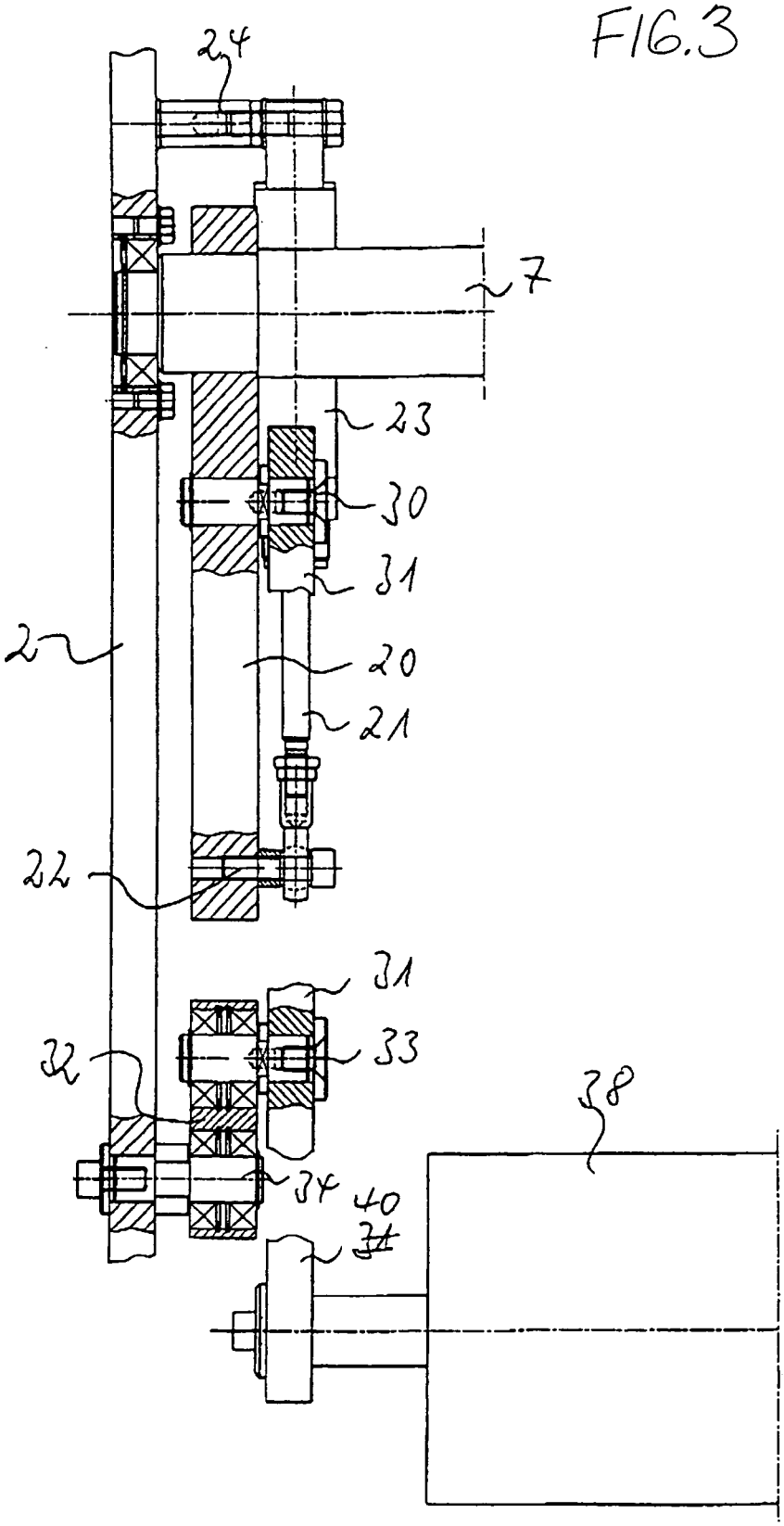

FIG. 2 shows the four-joint system for the approximate straight guide of the pressure roller 38, consisting of the guides and the steering rod, which has been pulled out of FIG. 1 for the purpose of better illustration. The guide forming rockers 20 on each side are attached to the pivoting shaft 7, or clamped to the same, which are supported between the side walls 2 of the carriage movable in the guides 3 of the side components 1 in the manner shown in FIG. 3. The guides 32 are pivot-supported on the axle journals 34, which are firmly connected to the side walls 2 in the manner shown in FIG. 3. The coupling elements or steering rods 31 are articulated in the joints 30 on the rockers 20, and in the joints 33 on the guides 32. The steering rods 31 surmount the rockers 20 by sections 40 of a certain length, between which the pressure roller 38 is supported.

The guide 32 is shorter than the rocker 20 between their joints 7 and 30. In the embodiment example illustrated, the guide 32 is inclined at a right angle in the direction of the rocker 20 based on its upper bearing 34. The different length of the rockers 20 and of the guides 32, as well as the distances of the joints 30 and 33 on the steering rods 31, and the lengths of the coupling rod sections 40 between the bearings for the pressure roller 38 and the bearings 30 on the rockers 20 are coordinated in such a manner that, during the pivoting of the steering rods between the position of the pressure roller 38 illustrated in FIG. 2 as a full line, in which the steering rods are displaced in the direction of the winding core, and the retreated position illustrated as a semi-colon line, the movement of the pressure roller occurs approximately linear in horizontal direction.

The rockers 20 surmount the steering rods 31 by sections 41 of a certain length toward the bottom. For each section a bearing journal 22 is provided below the steering rod 31, on which the piston rod 21 of the pneumatic cylinder 23 is supported, which in turn is pivot-supported on the journal 24 that is firmly connected to the side wall 2.

Tension springs 25 are spanned below the pneumatic cylinder 23 between the journals 26 of the sections 41 of the rockers 20 and the journals 27 provided on the side walls 2, which serve the purpose of increasing the adjusting range of the contact force that is exerted on the rockers 20 by means of the pneumatic cylinders 23.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A device for continuous winding of webs onto winding shafts or winding cores to winding rollers, comprising:

a frame;

a pressure roller that can be engaged with the winding shaft or winding core, or the winding roller, respectively;

front and rear guides having first ends and second ends, said first ends being pivotally supported on said frame by frame joints;

at least one steering rod supporting the pressure roller and pivotally connected to said second ends of said two guides by steering rod joints, said steering rod or one of said guides being equipped with a drive unit to effect substantially horizontal movement of said steering rod with said pressure roller supported thereon;

said front guide being nearest the winding roller and said rear guide being shorter in length than the front guide and oriented at an acute angle with respect to said front guide, said guides being pivotally movable on said frame and steering rod joints in response to said movement of said steering rod.

2. The device according to claim 1, wherein the pressure roller is supported between at least two steering rods which are each pivotally connected to said two guides, the other ends of said two steering rods being pivotally supported in the frame.

3. The device according to claim 1, wherein the drive unit includes a piston/cylinder unit.

4. The device according to claim 1, wherein the pressure roller is supported by a section of said steering rod which extends toward the winding roller and projects beyond the guides.

5. The device according to claim 1, wherein the guides are supported on a carriage that is movable in said frame.

6. The device according to claim 5, wherein the carriage is equipped with a controlled drive which moves said carriage in a substantially horizontal direction once the maximum substantially horizontal movement of said steering rod has been reached.

7. A device for continuous winding of a web onto a winding shaft, comprising:

a frame;

a pressure roller that cooperates with the winding shaft;

a rocker having a first end pivotally supported on said frame;

a guide horizontally spaced from said rocker and having a first end pivotally supported on said frame, said guide being further from said winding shaft than said rocker;

a coupling element having a rear end pivotally connected to a second end of said guide, and having a forward end pivotally connected to a second end of said rocker, said coupling element supporting said pressure roller adjacent said forward end; and a drive unit associated with said coupling element, said rocker or said guide for moving said coupling element and said pressure roller supported thereon in a substantially horizontal direction, said guide and said rocker being pivotally movable on each of their respective ends in response to said coupling element movement.

8. The device according to claim 7, wherein said coupling element is a steering rod.

9. The device according to claim 7, wherein the pressure roller is supported between at least two coupling elements which are each pivotally connected to said rocker and said guide.

10. The device according to claim 7, wherein the drive unit includes a piston/cylinder unit.

11. The device according to claim 10, wherein said drive unit is supported at one end on said frame and is pivotally supported at an opposite end on said rocker.

12. The device according to claim 7, wherein said coupling element includes a section adjacent said forward end that extends toward said winding shaft and projects beyond said rocker, said pressure roller being supported on said section.

13. The device according to claim 7, wherein the rocker and the guide are supported on a carriage that is movable in said frame.

14. The device according to claim 13, wherein the carriage is equipped with a controlled drive which moves said carriage in a substantially horizontal direction once the maximum substantially horizontal movement of said coupling element has been reached.

15. The device according to claim 7, wherein said guide is shorter in length than said rocker and extends toward said rocker from said frame at an acute angle.

* * * * *